US005607144A

United States Patent [19]

Brun et al.

[11] Patent Number: 5,607,144

[45] Date of Patent: Mar. 4, 1997

[54] FURNACE FOR REHEATING, HOLDING AND STORING OF METALLURGICAL PRODUCTS

[75] Inventors: Didier Brun, Le Chesnay; François Pahmer, Paris; Jean-Claude Audebert, Evry, all of France

[73] Assignee: Stein Heurtey, Ris Orangis, France

[21] Appl. No.: 524,675

[22] Filed: Sep. 8, 1995

[30] Foreign Application Priority Data

Sep. 27, 1994 [FR] France ..... 94 11527

[51] Int. Cl.[6] ..... C21B 3/00

[52] U.S. Cl. ..... 266/249; 266/274; 432/239

[58] Field of Search ..... 266/249, 250, 266/252, 274; 432/239, 246, 52

[56] References Cited

U.S. PATENT DOCUMENTS

| | | | |
|---|---|---|---|
| 3,915,441 | 10/1975 | Matsukawa et al. | 266/249 |
| 4,229,878 | 10/1980 | Ushijima | 432/239 |
| 4,982,934 | 1/1991 | Bonino et al. | 266/249 |
| 5,314,169 | 5/1994 | Kamlani et al. | 266/274 |

FOREIGN PATENT DOCUMENTS

| | | |
|---|---|---|
| 2431445 | 2/1980 | France . |
| 653956 | 11/1937 | Germany . |
| 60-056013 | 4/1985 | Japan . |

*Primary Examiner*—Scott Kastler
*Attorney, Agent, or Firm*—Pollock, Vande Sande & Priddy

[57] ABSTRACT

Furnace for storing, reheating and holding ferrometallurgical products, in which the products travel along a displacement path on members placed so as to connect, in the tranverse direction, a charging zone and a discharging zone, the reheating and holding zones including, on the one hand, product-supporting members and transporting members placed at a certain distance from the supporting members and being able to perform a rising movement with respect to these and a horizontal displacement movement making the product advance step by step. The storage includes, in addition to the supporting members and transporting members of the type described hereinabove, at least one set of movable supporting members, independent of the hearth of the furnace, able to move with a horizontal alternating translational movement which is performed during the return phase of the transporting members and, upon a complete rectangular cycle of the transporting members, the charge (P) has progressed forwards by a distance equal to the sum of the steps of the displacements of the supporting members and the transporting members.

2 Claims, 1 Drawing Sheet

FURNACE FOR REHEATING, HOLDING AND STORING OF METALLURGICAL PRODUCTS

FIELD OF THE INVENTION

The present invention relates to a furnace for reheating, holding and accumulating ferrometallurgical products.

BACKGROUND OF THE INVENTION

Flat products and long products treated in hot-rolling mills, in order to form sheets, strips, beams, bars, etc., are more and more frequently made from liquid steel contained in a ladle and continuously cast in a mould followed by rolls which allow extraction of the shape obtained by controlled cooling of the steel just sufficient for going from the liquid-metal form into the solid form, the semi-finished product thus obtained on leaving continuous casting generally being at a temperature greater than 1000° C. On account of the high temperature of the semi-finished product, rolling it immediately after casting represents a substantial energy saving compared to the conventional process which consists in storing the semi-finished products before reheating them up to 1250° C. in order to be able to roll them.

In many factories comprising a steel works and a hot-rolling mill, means are employed for carrying out the continuous casting and hot rolling of semi-finished products without systematically passing via a cooling and storage area. However, this approach comes up against three main technico-economic difficulties:

- The first is due to the lack of temperature homogeneity of the semi-finished products leaving the continuous casting because of the preferential cooling of the corners and sides of the products, which necessitates top-up reheating and homogenizing of the semi-finished products before rolling.
- The second, even more restricting, arises from programmed and especially non-programmed stoppages of the rolling mill in the course of production in order to change a roll or to make corrections to the various settings. During these stoppages, the liquid steel present in the ladles must necessarily be cast in the form of semi-finished products without being able to be immediately rolled it is therefore necessary to be able to store them hot for periods ranging from a few minutes to sometimes an hour or more.
- Finally, the third difficulty is of an economic nature since the continuous casting equipment is also exposed to unpredictable maintenance and production factors and undergoes quite lengthy stoppage periods which do not necessarily coincide with those of the rolling mill. In order to improve the profitability of the factories, the rolling mill must in such cases be fed with semi-finished products not coming directly from casting and which, consequently, must be reheated from ambient temperature.

Many known items of equipment may be used either for storage at the casting temperature or for reheating or homogenizing the products coming from casting in particular, the invention described by Patent EP 0,370,916 B1 describes a reheating, holding and accumulating furnace which includes two sets of supporting members and of transporting members, both of which can move in the vertical direction and be located in planes which are below, at the same level as or above the reference plane given by the rollers which enable the ferrometallurgical products to be charged and discharged and, by combining the respective planes of the supporting members and of the transporting members, this being so as to move or not move through one step the products lying on each of the sets of supporting members.

In the furnace described by the aforementioned patent, the movement from charging to discharging is controlled so as either to accumulate the ferrometallurgical products in the first zone defined by he first set of supporting members or to make them pass through this zone as rapidly as possible in order to feed the rolling mill and to create a space available in the furnace for possibly storing therein products coming from the continuous casting in the event of a stoppage of the rolling mill.

The drawback of the prior art resides in the limitation in the transfer speed which may not be equal to or less than the cycle time and to the possible travel of the transporting members. These transporting members follow a rectangular cycle having a total duration of the order of 40 seconds or more, including a first, rise phase which enables the supporting members to be released, a second phase of horizontally transporting and then a third phase of depositing the products which have thus progressed by one step on the supporting members, before the fourth step of return to the rear into the initial position it may be seen that during phases one, three and four, the products do not move, and therefore only a quarter of the cycle is active with regard to progression of the products inside the furnace and, moreover, the step or translation in the horizontal plane of the transporting members is generally limited to less than 0.6 m because of the necessary combination of the vertical and horizontal movements of the mechanism This limitation may constitute a serious handicap both as regards the production capacity of the furnace and its capacity to free up, for charging purposes, a space sufficient to store products coming from casting if the stoppage of the rolling mill should prove to be longer than anticipated or than usual. Moreover, the slow rate of transfer of the products through the storage zone, which speed represents an advantage when the products charged are practically cold, is a drawback when the semi-finished products are arriving directly from continuous casting since it requires this zone to be held at a high temperature in order to prevent the products from cooling before their entry into the reheating zone. This high-temperature hold is a handicap both from an energy standpoint and an environmental standpoint since, in normal operation, the products coming from continuous casting must reach the reheating zone or even the homogenizing zone as rapidly as possible and, consequently, the storage zone is empty.

The present invention intends to alleviate these drawbacks by providing a satisfactory solution simultaneously to the problem of rate of transfer of the products and to that of holding the storage zone at a high temperature, by making it possible to profit from the fourth phase of rearward return of the transporting members in order to advance the products into the furnace, as will be seen in the following device. Added to the possibility of reheating cold products is the possibility of being able, during running, to modify the residence time of the semi-finished products according to their temperature at charging.

For this purpose, the furnace for storing, reheating and holding ferrometallurgical products, in which the products travel along a displacement path on members placed so as to connect, in the transverse direction, a charging zone and a discharging zone, the reheating and holding zones including, on the one hand, product-supporting members and transporting members placed at a certain distance from the said supporting members and being able to perform a rising movement with respect to these and a horizontal displacement movement making the product advance step by step, is characterized in that the said storage zone furthermore includes supporting and transporting members of the type described hereinabove, at least one set of movable supporting members, independent of the hearth of the furnace, able to move with a horizontal alternating translational movement which is performed during the return phase of the transporting members.

Other characteristics and advantages of the present invention will emerge from the description given below, with reference to the appended drawings which illustrate an embodiment example thereof, devoid of any limiting character. In the figures:

DETAILED DESCRIPTION OF THE INVENTION

Figure 1:
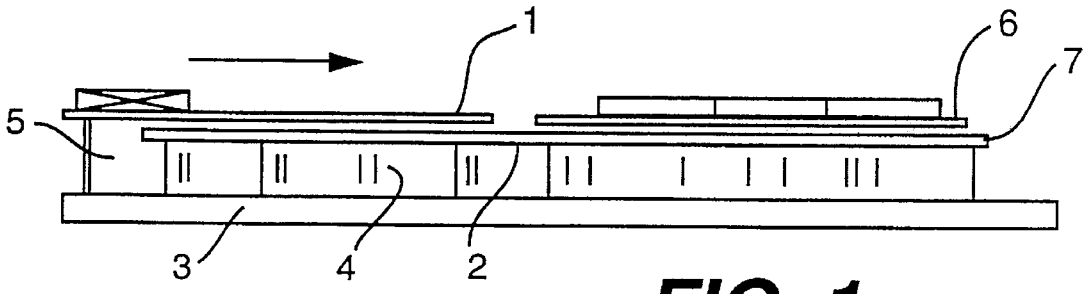
FIG. 1 is a front-elevation sectional view of a furnace according to the invention, illustrating the phase of advancement of the set of supporting members, which support the ferrometallurgical product.

According to a preferred embodiment, the furnace forming the subject of the present invention includes two or more storage, reheating and holding zones. In this non-limiting embodiment, the furnace includes a zone called the storage zone which, in normal operation, must remain available for receiving the cast products in the event of a stoppage of the rolling mill, a reheating zone, and a homogenizing zone before discharge. The reheating and homogenizing zones are designed like the usual reheating furnaces, including transporting members 2 called movable members or supporting members 1 called fixed members, the four-phase cycle described in the prior art allowing the movable members 2 to transport the products by one step per cycle from the entrance of the reheating zone as far as discharge at speeds varying generally from 0.9 m/min to 0.3 m/min or less. The storage zone includes transporting members 2 fastened to a structure-4, such as those produced in the reheating and homogenizing zones and one or two sets of supporting members 1 which, in by contrast with a usual furnace, are not fastened to the fixed hearth 3 of the furnace, or as described in the previously mentioned patent.

The furnace forming the subject of the invention includes a structure 5 comprising a plurality of supporting members 1, which is independent of the hearth 3 of the furnace and capable of a forward or rearward horizontal translational movement. These sets of supporting members 1, subjected only to a horizontal translation, can have a travel of 1 m or more, depending on the feed requirements of the furnace. This horizontal displacement is performed with the charge during phase four of the return of the transporting members 2, thereby enabling the products to be displaced by the step of the supporting members 1 linked to the structure 5, for example 1 m, this step being added to that, for example of 0.6 m, performed by virtue of phase two of the transporting members 2 linked to the structure 4.

This combination of movements in the course of a single cycle of the transporting members makes it possible to obtain a total displacement (the displacement and time values are give by way of indication) of:

0.6 m (the step of the transporting members 2) +1 m (the step of the supporting members 1)=1.6 m during the normal cycle time of 40 seconds, that is a step 2.66 times longer than that obtained with the usual combinations of transporting members 2 and supporting members 1.

The rate of transport through the storage zone is thus multiplied by at least 2.66 in this example, reducing the residence time in the same proportion under these conditions, it becomes unnecessary for the storage zone to be held at high temperature during normal production, and its temperature may be held just by the flue gases coming from the reheating and homogenizing zones going towards the flues leading to the smokes tack for removing the combustion products from the furnace.

Figure 2:
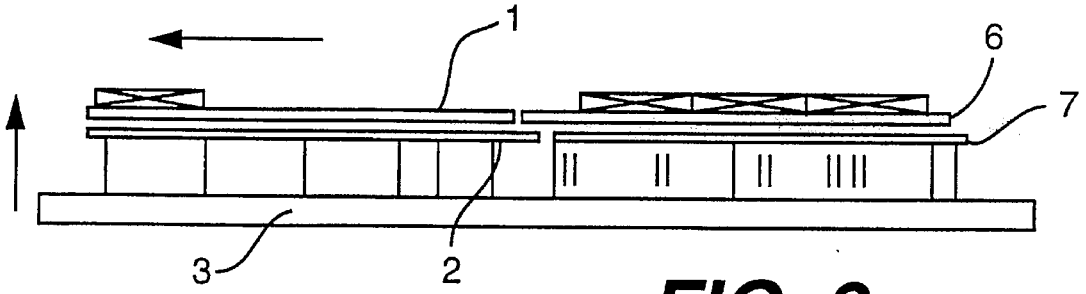
FIG. 2 is a front-elevation sectional view of a furnace according to the invention, illustrating the movement of the set of movable members beneath the group of support members.
Figure 3:
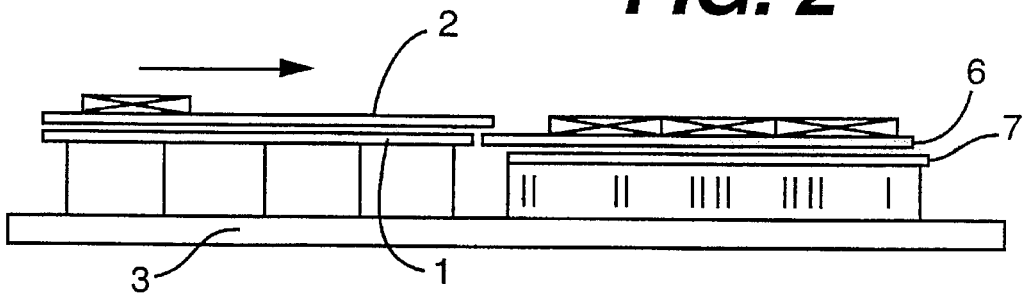
FIG. 3 is a front-elevation sectional view of a furnace according to the invention, illustrating the transfer of the charge from the set of supporting members to the set of transporting members.
Figure 4:
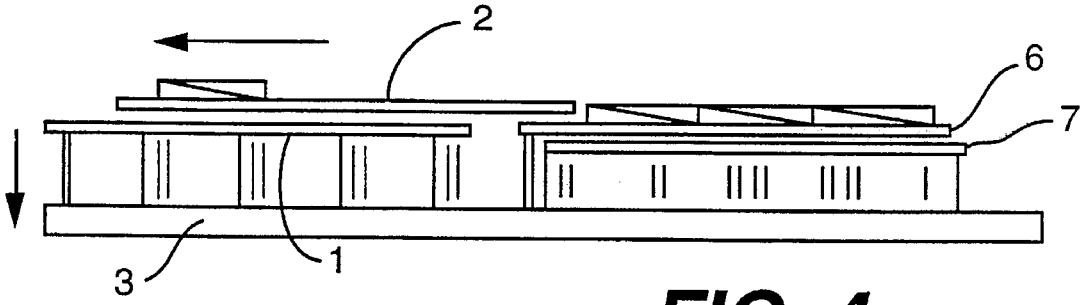
FIG. 4 is a front-elevation sectional view of a furnace according to the invention, illustrating the movement of the set of supporting members below the set of transporting members.
Figure 5:
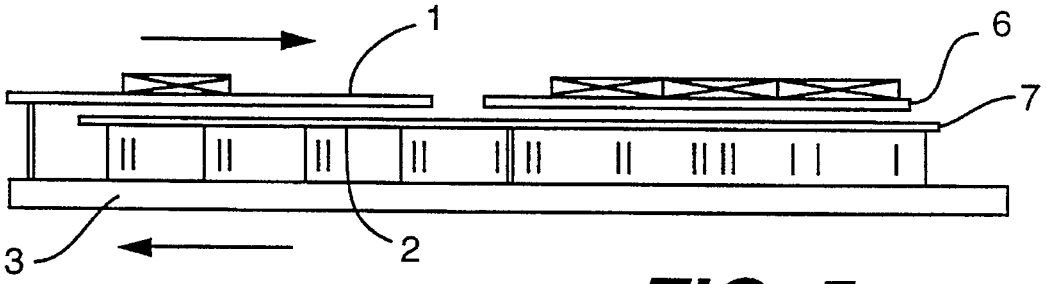
FIG. 5 is a front-elevation sectional view of a furnace according to the invention, illustrating the transfer of the charge from the set of transporting members to the set of supporting members, thus delimiting a complete cycle of movements of the set of supporting members and transporting members.

In order to illustrate the operation of the furnace forming the subject of the invention, we give below a chronology of the various phases of the cycle:

In FIG. 1, the product P has been loaded, by a usual means found in reheating furnaces, at the entry to the furnace onto the set of supporting members 1, which is in a rear position with respect to the fixed supporting members 6 of the subsequent zones, the set of supporting members 1 moves forwards by a complete step A (1 m in the example), while (FIG. 2) the movable transporting members 2 move in the opposite direction under the charge P, by the amount of a step B (0.6 m in the example). In FIG. 3, the transporting members 2 move vertically upwards, freeing the sets of supporting members 1 of their charge of product P which now rests on the members 2 which advance by a step B (0.6 m) while (FIG. 4) the sets of supporting members 1 move backwards by a step A (1 m) in order to resume their initial position. Having arrived at the end of horizontal travel, the transporting members 2 move vertically downwards, resting the charge P on the supporting members 1 (FIG. 5). The charge P has therefore progressed forwards by the cumulative amount of step A (FIG. 1) and step B (FIG. 3) during a complete rectangular cycle of the transporting members 2.

This progression, summing steps A+B, continues until the product P reaches the next, reheating, zone, that is to say the sets of supporting members 6 which are fixed. From the moment when the product P is on the sets of supporting members 6, it is transported to the discharging point by means of the normal rectangular cycle of the transporting members 7, therefore at a speed corresponding to the single step 7, which is usually equal to the step of the first set of transporting members 2 (0.6 m in the example).

The rate of displacement of the products in the storage zone allows the latter to be empty, in normal operation in the event of stoppage of the rolling mill, the system of the set of supporting members 1 remains in the fixed position and the products are transported from charging to discharging via the transporting members 2, the progression being by a step B at each cycle depending on the required production, the cycles form a chain sequence (every 40 s, in the example), in order to free a charging space intended for a product coming from the continuous casting, or are separated by a stoppage time which may be several minutes, giving rates of displacement of the order of 0.3 m/min or less.

In the case of the charging with warm or even cold products, the residence time in the storage zone has to be put to use in order to preheat the product before it arrives in the reheating zone the rate of displacement of the products must therefore be modulated, which may be achieved by increasing the stoppage times between two successive cycles and by varying the step A from 0 m to the maximum step A (1 m, in the example) as well as the step of the transporting members from 0 m to B (0.6, in the example). The combination of these variations in the storage zone, independently of the movements of the products in the reheating zone, makes it possible to vary the time spent by the product in passing through the storage zone from the minimum time, combining the successions of cycles and the maximum steps, to infinity if the steps are of zero length, that is to say that the products stay put and are regularly raised by the transporting members 2 and then redeposited at the same place onto the sets of supporting members 1.

It remains obvious that the present invention is not limited to the embodiment examples described and represented hereinabove, but that it encompasses all the variants thereof. Thus, in the usual cases of continuous casting feeding a hot rolling mill through a storage and reheat/homogenization furnace, it would seem to be sufficient to equip a single zone with the sets of supporting members driven in horizontal translational movement, and it may be perfectly conceivable, for reasons of flexibility or of feed from several casting lines for example, for two or all of the zones of the furnace to be able to include such sets of supporting members. It is also possible to take account of the running conditions which make it necessary to return the products, this being easily achieved by reversing the previously described order of the movements and by using the horizontal return cycle of the supporting members on which the products rest while the transporting members, in the low position, progress forwards.

We claim:

1. A furnace for storing, reheating and holding ferrometallurgical products, in which the products travel along a displacement path on members placed so as to connect, in the transverse direction, a charging zone and a discharging zone, the furnace comprising: product supporting members; and transporting members placed at a predetermined distance from the supporting members for performing a rising movement and a horizontal displacement relative to the supporting members, making the product advance step by step, wherein at least one set of supporting members moves, independently of a furnace hearth, with a horizontal alternating translational movement which is performed during a return phase of the transporting members and, upon a complete rectangular cycle of the transporting members, the products having progressed forwards by a distance equal to the sum of the steps of the displacements of the supporting members and the transporting members.

2. Storage furnace according to claim 1 further comprising means for ensuring that the rate of travel of the products is modulated between a zero speed, in the absence of horizontal translation of the supporting members and the transporting members, and a maximum speed corresponding to the combination of each of the speeds of each set of supporting members and transporting members, in order to take into account the use and charge conditions of the furnace.

* * * * *